US006778091B2

(12) United States Patent
Qualey, III et al.

(10) Patent No.: US 6,778,091 B2
(45) Date of Patent: Aug. 17, 2004

(54) SMOKE CHAMBER

(76) Inventors: James R. Qualey, III, 4 Meadow View Rd., Rindge, NH (US) 03461-3457; Louis Desmarais, 5 Mistletoe Dr., Ashburnham, MA (US) 01430; Jayanthi Prasad, 6 Hawthorne Rd., Lexington, MA (US) 02420; Lawrence G. Stanley, 207 Partridgeville Rd., Templeton, MA (US) 01468; Donald D. Brighenti, 42 Dawley Rd., Westminster, MA (US) 01473

( * ) Notice: Subject to any disclaimer, the term of this patent is extended or adjusted under 35 U.S.C. 154(b) by 526 days.

(21) Appl. No.: 09/757,081

(22) Filed: Jan. 9, 2001

(65) Prior Publication Data

US 2002/0089426 A1 Jul. 11, 2002

(51) Int. Cl.[7] ..... G08B 17/10

(52) U.S. Cl. ..... 340/628; 340/630; 340/693.6; 250/574

(58) Field of Search ..... 340/628, 630, 340/693.6; 361/756, 758; 250/564, 574, 554

(56) References Cited

U.S. PATENT DOCUMENTS

| | | | | |
|---|---|---|---|---|
| 3,710,365 A | | 1/1973 | Barnes | 340/630 |
| 3,916,209 A | | 10/1975 | Steele et al. | 250/574 |
| 4,124,298 A | | 11/1978 | Steele | 356/338 |
| 4,236,822 A | | 12/1980 | Jaretsky et al. | 356/256 |
| 4,249,082 A | | 2/1981 | Kakigi et al. | 250/574 |
| 4,315,158 A | | 2/1982 | Kakigi et al. | 250/574 |
| RE32,105 E | | 4/1986 | Enemark | 340/630 |
| 4,584,485 A | | 4/1986 | Powers et al. | 250/574 |
| D284,272 S | | 6/1986 | Chen | D10/106 |
| 4,596,465 A | | 6/1986 | Nagashima | 356/338 |
| D284,748 S | | 7/1986 | Fenne | D10/106 |
| 4,672,217 A | | 6/1987 | Dobrzanski | 250/574 |
| 4,700,079 A | | 10/1987 | Ito | 250/574 |
| 4,724,430 A | | 2/1988 | Igarashi | 349/693 |
| 4,845,474 A | | 7/1989 | Moore et al. | 340/629 |
| 4,897,634 A | | 1/1990 | Sawa et al. | 340/630 |
| 4,906,978 A | | 3/1990 | Best et al. | 340/630 |
| 4,914,425 A | | 4/1990 | Kaminaka et al. | 340/693 |
| 4,937,562 A | | 6/1990 | Kaminaka et al. | 340/163 |
| 5,021,677 A | * | 6/1991 | Igarashi et al. | 250/574 |
| 5,138,302 A | | 8/1992 | Nagaoka et al. | 340/630 |
| 5,400,014 A | | 3/1995 | Behlke et al. | 340/630 |
| D358,351 S | | 5/1995 | Behlke | D10/106 |
| D358,352 S | | 5/1995 | Behlke | D10/106 |
| D358,353 S | | 5/1995 | Behlke | D10/106 |
| 5,430,307 A | | 7/1995 | Nagashima | 250/574 |
| 5,486,816 A | | 1/1996 | Ariga et al. | 340/630 |
| D367,434 S | | 2/1996 | Feldman | D10/106 |
| D367,623 S | | 3/1996 | DeWitt | D10/106 |
| 5,546,074 A | * | 8/1996 | Bernal et al. | 340/628 |
| 5,629,671 A | | 5/1997 | Morita | 340/515 |
| 5,642,099 A | | 6/1997 | Nagashima | 340/630 |
| D382,825 S | | 8/1997 | Amleshi | D10/106 |
| 5,659,293 A | | 8/1997 | Shibata et al. | 340/628 |
| 5,670,947 A | | 9/1997 | Nagashima | 340/628 |
| 5,821,866 A | | 10/1998 | Bernal et al. | 340/630 |
| 6,288,647 B1 | * | 9/2001 | Yamano | 340/630 |
| 6,300,876 B1 | * | 10/2001 | Sakurai et al. | 340/630 |

FOREIGN PATENT DOCUMENTS

| | | | | |
|---|---|---|---|---|
| JP | 355144527 A | * | 11/1980 | 340/628 |

* cited by examiner

*Primary Examiner*—Anh V. La

(57) ABSTRACT

A smoke detecting chamber for use in a light-scattering type smoke detector is provided which includes a chamber cover that forms one side of the smoke detecting chamber. The chamber cover includes a plurality of first baffles that prevent external light from entering the smoke chamber. The smoke detector further includes a chamber base that forms another side of the smoke detecting chamber, the chamber base including a plurality of second baffles that intermesh with the first baffles when the smoke detecting chamber is formed.

23 Claims, 14 Drawing Sheets

SMOKE CHAMBER

BACKGROUND OF THE INVENTION

In a typical light-scattering smoke detector, infrared rays are emitted into a smoke detecting chamber. When smoke enters the smoke chamber, the infrared rays are scattered by the smoke and detected by a light receiving device, such as a photodiode. It is preferable to have a compact smoke detector for aesthetic reasons, so as not to prominently protrude, for example, from a building ceiling.

It is important that the smoke chamber have a large enough opening for allowing smoke to easily flow therein, while excluding ambient light which can initiate nuisance alarms.

Numerous designs have been previously proposed to accomplish the foregoing, for example, as disclosed in U.S. Pat. Nos. 4,315,158 to Kakigi et al. and 5,670,947 to Nagashima. Typical designs include a series of labyrinth members which form the wall around the smoke chamber and which allow the smoke into the chamber while excluding ambient light.

SUMMARY OF THE INVENTION

Prior art light-scattering smoke detectors have failed to provide a relatively compact smoke chamber which excludes ambient light even when the components that form the smoke chamber are slightly misaligned. Accordingly, a smoke detecting chamber for use in a light-scattering type smoke detector is provided which includes a chamber cover that forms one side of the smoke detecting chamber. The chamber cover includes a plurality of first baffles that prevent external light from entering the smoke chamber. The smoke detector further includes a chamber base that forms another side of the smoke detecting chamber, the chamber base including a plurality of second baffles that intermesh with the first baffles when the smoke detecting chamber is formed.

A smoke detector is also provided which includes a printed circuit board having a first side and a second side with electronic components positioned on the first side of the board. A can for isolating the electronic components from external radio frequency emissions covers the electronic components on the first side of the board. A smoke detecting chamber is formed on the second side of the board by a chamber cover and a chamber base. An optical bench is disposed between the second side of the board and the smoke detecting chamber. The optical bench holds an emitting device, that emits radiation into the smoke chamber, and a sensing device that senses radiation from the emitting device when smoke fills the smoke detecting chamber.

In alternative embodiments, a smoke detector is provided which includes a printed circuit board having a first side and a second side. A smoke detecting chamber, which can be formed with a chamber cover and a chamber base, is positioned on the second side of the board. An emitting device is configured to emit radiation into the smoke chamber. A sensing device, positioned on the first side of the board, senses radiation from the emitting device when smoke fills the smoke detecting chamber. The smoke detector further includes a lens, combined with a reflecting element such as a prism, that redirects radiation through an aperture in the board to the sensing device. An optical bench preferably holds the emitting device and the lens.

In another embodiment, a smoke detector is provided which includes a smoke detecting chamber, an emitting device that emits radiation into the smoke chamber, and a sensing device that senses radiation from the emitting device when smoke fills the smoke detecting chamber. A first reflecting surface is provided in the smoke detecting chamber wherein at least a portion of the reflecting surface is directly impinged by the radiation from the emitting device. A second reflecting surface in the smoke detecting chamber is configured to reflect radiation reflected by the first reflecting surface toward the sensing device. The reflectors provide a clean air background signal.

Preferably, the smoke chamber is formed by a chamber cover and a chamber base and the first and second reflecting surfaces extend from the chamber cover. The emitting device and the sensing device include optical axes which preferably intersect in the range of between about 30 and 40 degrees, preferably about 37.5 degrees.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
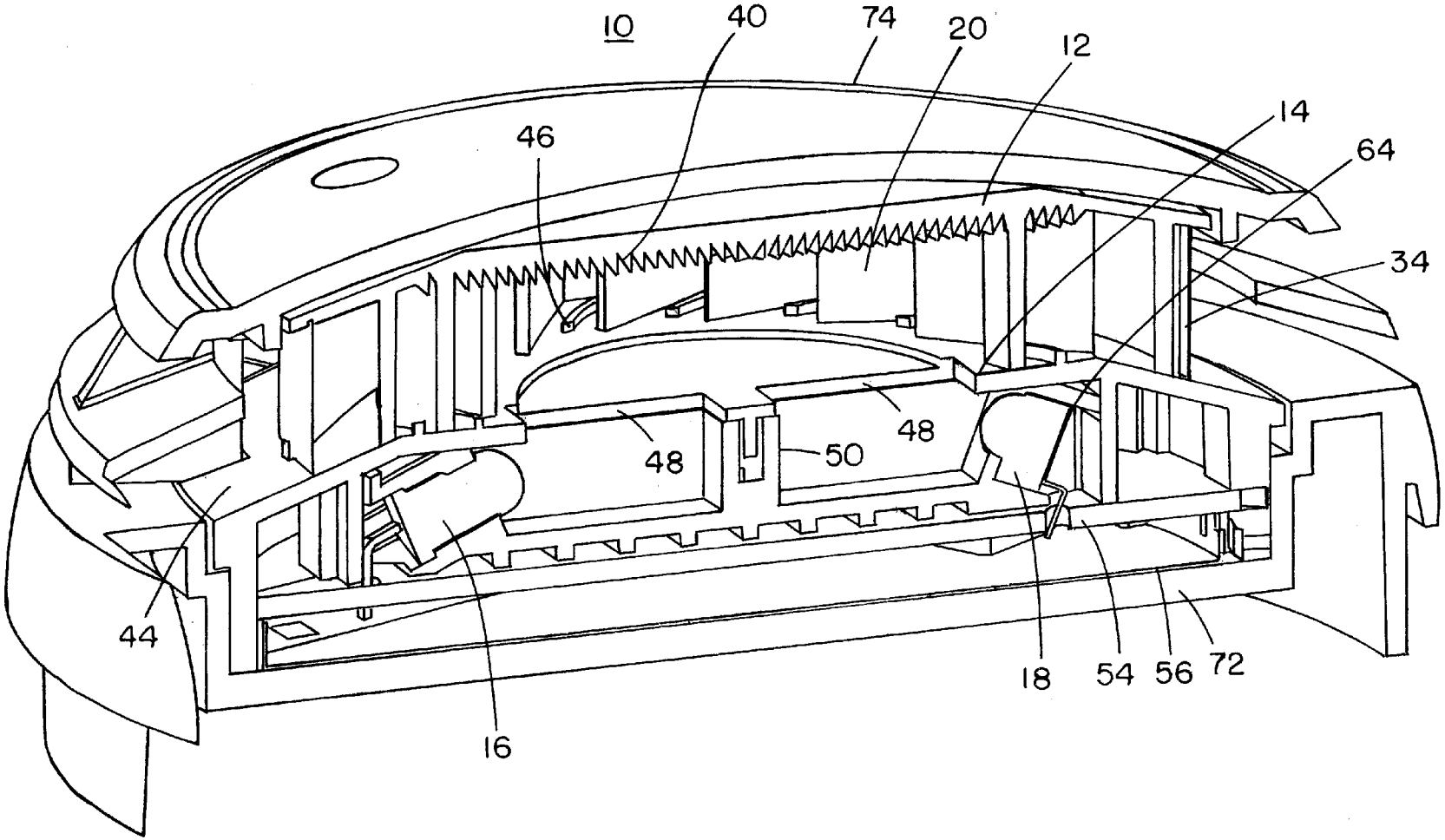
FIG. 1 is a cross-sectional isometric view of a smoke detector in accordance with the present invention.
Figure 2:
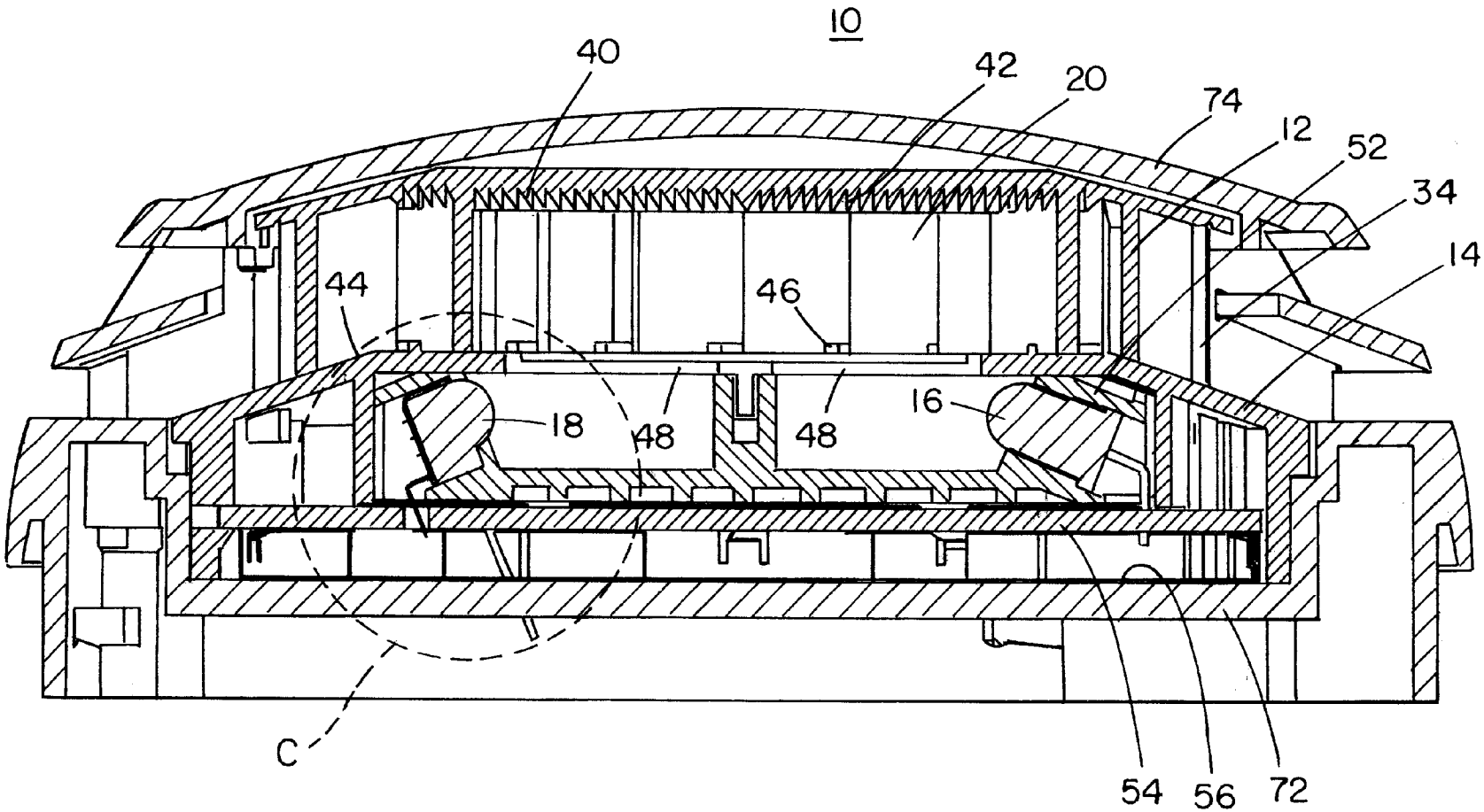
FIG. 2 is a cross-sectional view of the smoke detector of FIG. 1.
Figure 3:
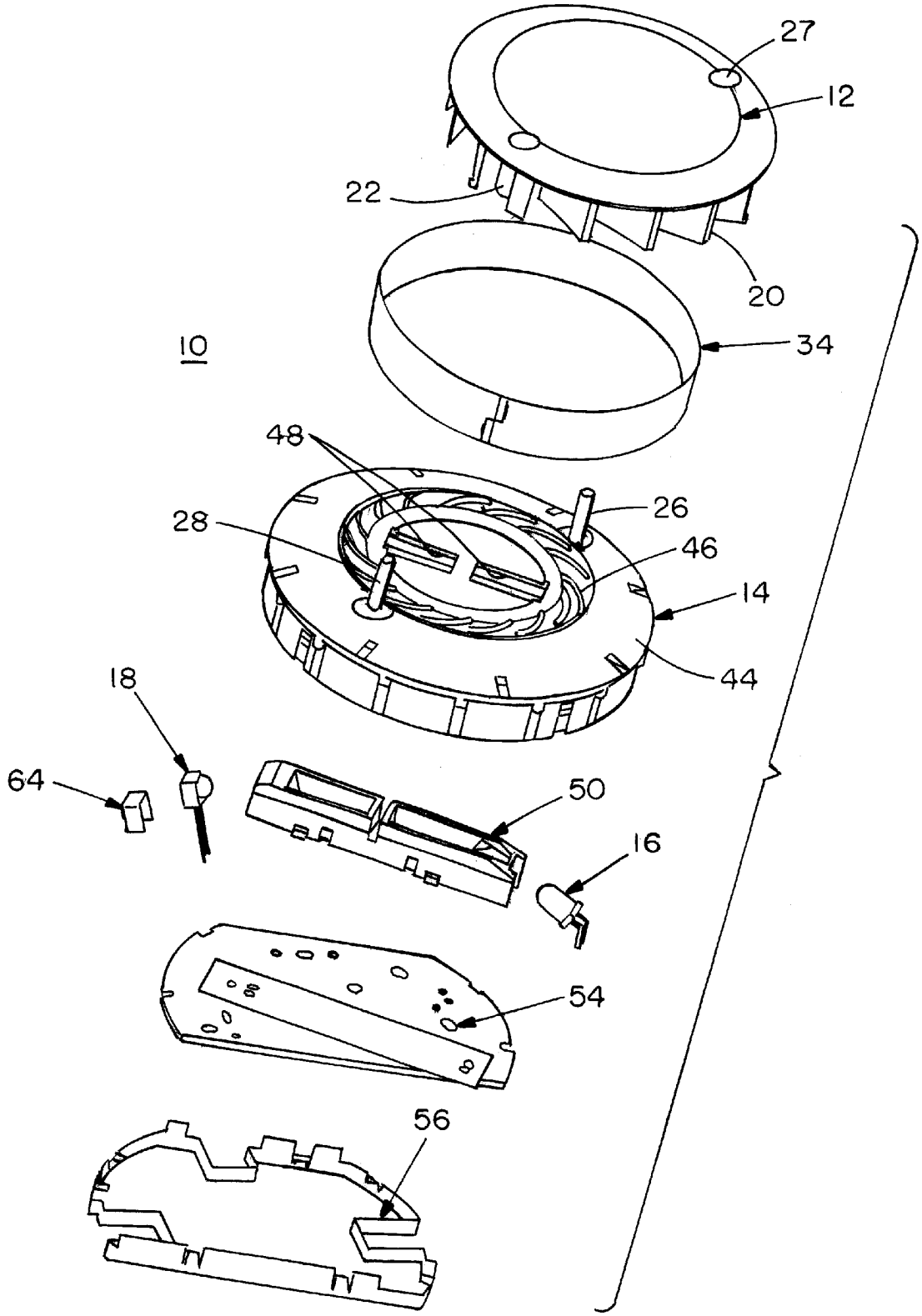
FIG. 3 is an isometric exploded view of the smoke detector of FIGS. 1 and 2.

A description of preferred embodiments of the invention follows. FIGS. 1–3 illustrate one embodiment of a smoke detector in accordance with the present invention, generally designated as reference numeral 10. Generally, the detector 10 includes a smoke chamber formed by a chamber cover 12 and a chamber base 14. An emitting device 16, such as an IR LED, emits radiation into the smoke chamber through apertures 48. When smoke enters the smoke chamber, it is scattered and detected by a sensing device 18, such as a photodiode, and an alarm condition is signaled.

Figure 4:
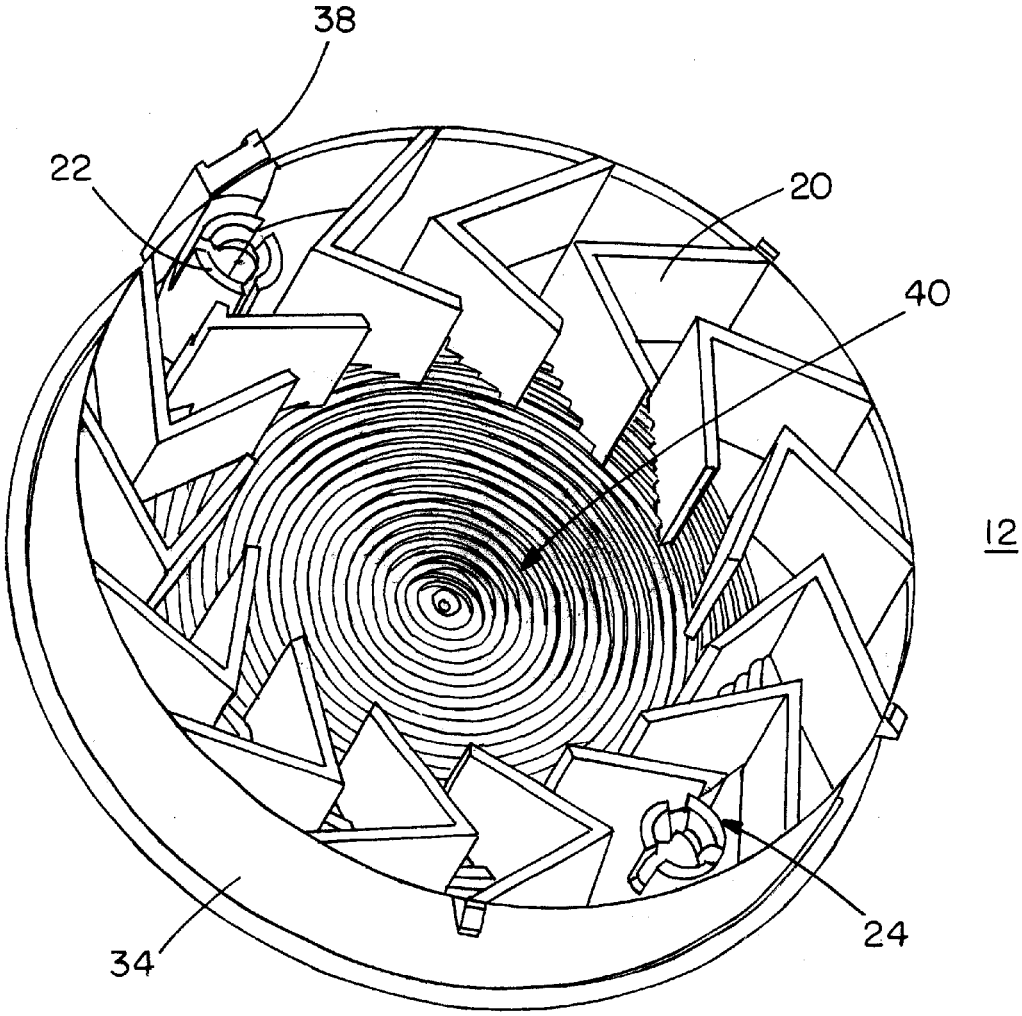
FIG. 4 is an isometric view of the chamber cover illustrated in FIGS. 1–3.

As illustrated in FIG. 4, the chamber cover 12 includes a plurality of baffles 20 which form the outer wall of the smoke chamber. The baffles 20 are preferably V-shaped and are configured to exclude ambient light from entering the smoke chamber. In one embodiment, 15 V-shaped baffles are evenly spaced at 24 degree intervals around the chamber cover 12.

Figure 7:
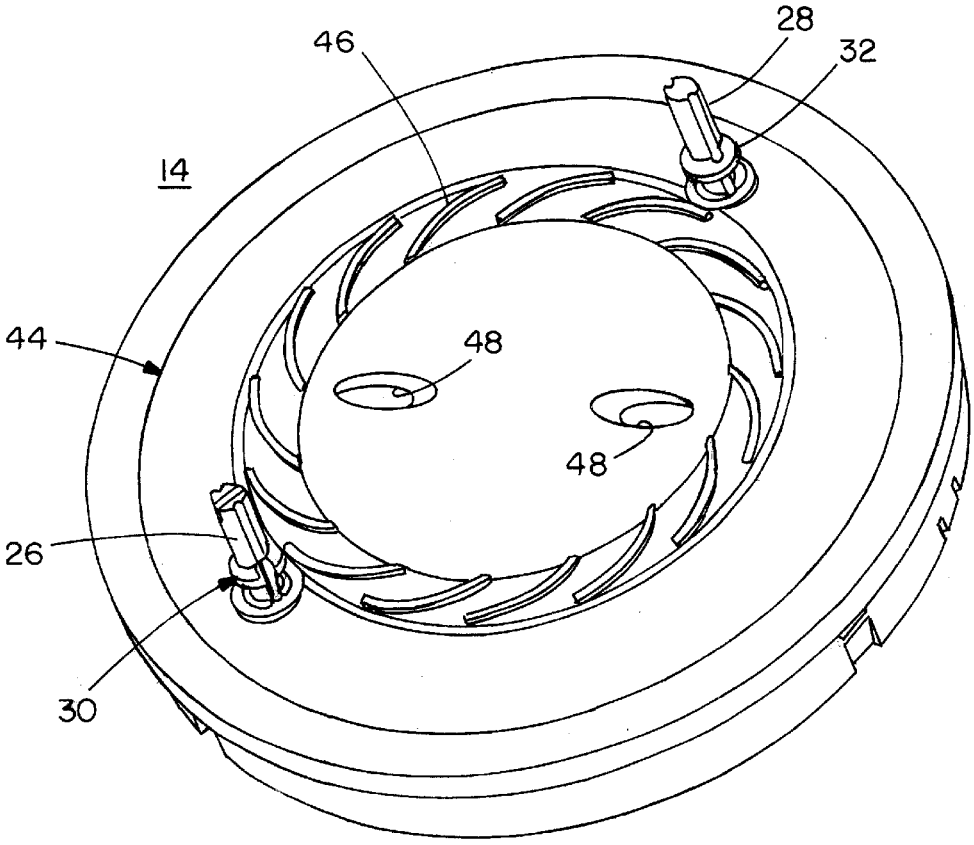
FIG. 7 is an isometric view of a first side of the chamber base illustrated in FIGS. 1–3.

The chamber cover 12 preferably snap-fits onto the chamber base 14. In one embodiment, the chamber cover 12 includes a first retaining member 22 and a second retaining member 24 (FIG. 4) which slide over respective projections or posts 26, 28 (FIG. 3) of the chamber base 14. The retaining members 22, 24 expand over respective wider portions 30, 32 of projections 26, 28 (FIG. 7) and snap-fit thereon. Preferably, the projections 26, 28 and retaining members 22, 24 are robust and sturdy enough so as to be not easily breakable, even after multiple snap-fit cycles.

In one embodiment, the projection 26 includes a signaling device, such as an LED, which is exposed through an aperture 27 to signal that the detector 10 is on. The projection 28 can include a measuring device, such as a thermistor, to measure ambient temperature. If the temperature exceeds a predetermined threshold, the detector 10 signals an alarm condition. The signaling device and the measuring device are included in the respective projections 26, 28 to conserve valuable space in the detector 10.

Figure 5:
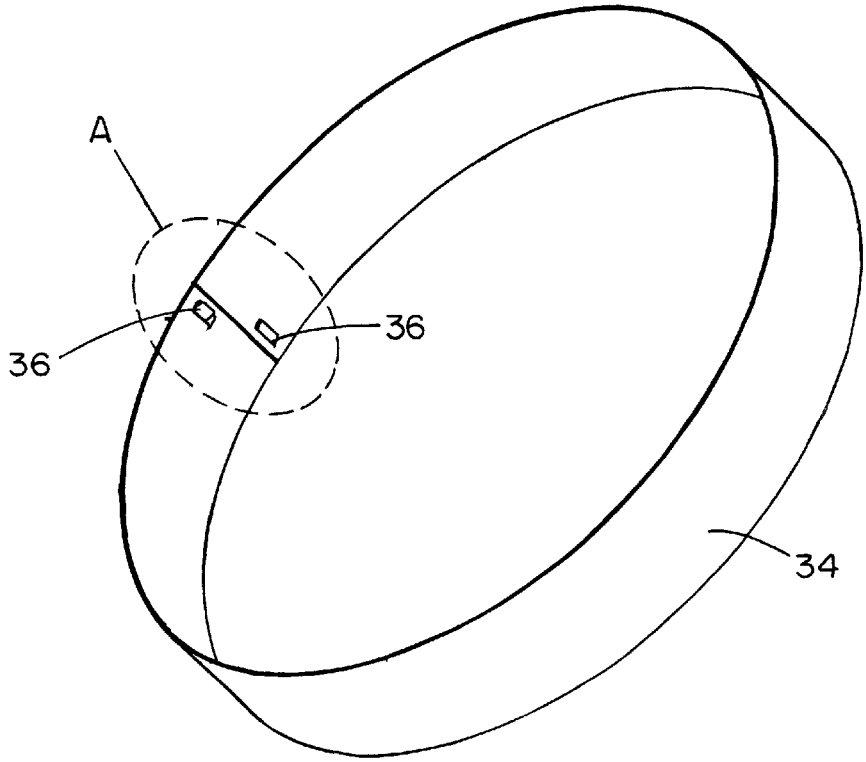
FIG. 5 is an isometric view of the bug chamber illustrated in FIGS. 1–3.
Figure 6:
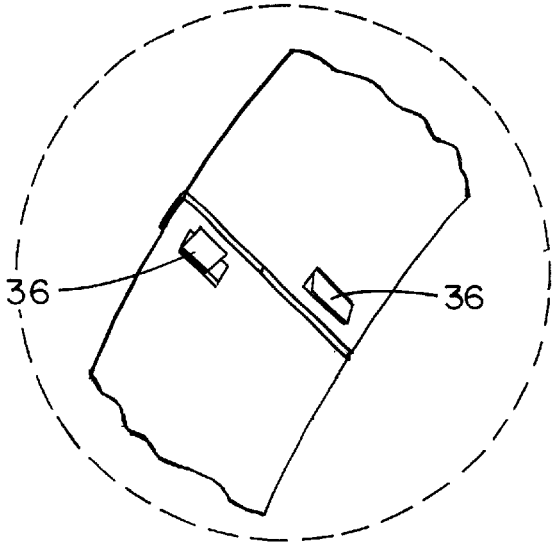
FIG. 6 is an enlarged view of area "A" of FIG. 5.

A bug screen 34 is disposed between the chamber cover 12 and the chamber base 14 to keep insects and the like out of the smoke chamber. As illustrated in FIGS. 5 and 6, the bug screen 34 is locked together at the ends via locking tabs 36. In one embodiment, the chamber cover 12 includes a retaining wall 38 for securing the bug screen 34 in place. Preferably, the bug screen 34 is photoetched stainless steel.

The chamber cover 12 preferably includes a plurality of circumferential grooves 40 for controlling propagation of stray external light that may enter the chamber and radiation emitted from the emitting device 16. In one embodiment, faces 42 of grooves 40 are angled approximately 30 degrees relative to a chamber axis A—A (see FIG. 2). The other face of each groove 40 is parallel to the chamber axis. Propagation of stray light can also be controlled by specifying the reflectance (IR and visible) and surface texture of the detector 10 components, such as the chamber cover 12 and chamber base 14.

The chamber base 14 includes an annular ramp 44 which serves to provide additional volume for the electronic components which are positioned underneath. The ramp 44 can also facilitate the entry path of the smoke into the smoke chamber. More particularly, the ramp 44 provides a slope which allows the smoke to travel towards the smoke chamber. In one embodiment, the baffles 20 conform to the annular ramp 44.

The chamber base 14 also includes a plurality of ridges or baffles 46 that intermesh with the baffles 20 of the chamber cover 12 when the smoke chamber is formed. This arrangement prevents entry of ambient light even when the chamber cover 12 and chamber base 14 are slightly misaligned or do not substantially conform to one another. In one embodiment, there are a total of fifteen baffles 46.

In one embodiment, the emitting device 16 and the sensing device 18 are positioned below the chamber base 14. In one embodiment, the chamber base 14 has apertures 48 therethrough which allow the emitting and sensing devices 16, 18 to communicate with the smoke chamber. The emitting device 16 and the sensing device 18 are held in position by a metering structure or optical bench 50. The optical bench 50 fixes the position and alignment of the emitting device 16 and sensing device. In one embodiment, the angle between the optical axes of the devices 16, 18 is 45 degrees, resulting in a scattering angle of 45 degrees.

In one embodiment, the chamber base 14 has integrally molded snaps 52 (FIG. 8) such that the optical bench 50 can snap-fit to the chamber base. This provides a quick and easy mechanism to align the emitting device 16 and the sensing device 18. The chamber base 14 can also include a light blocking member or wall 70 for containing radiation of the emitting device 16.

Figure 8:
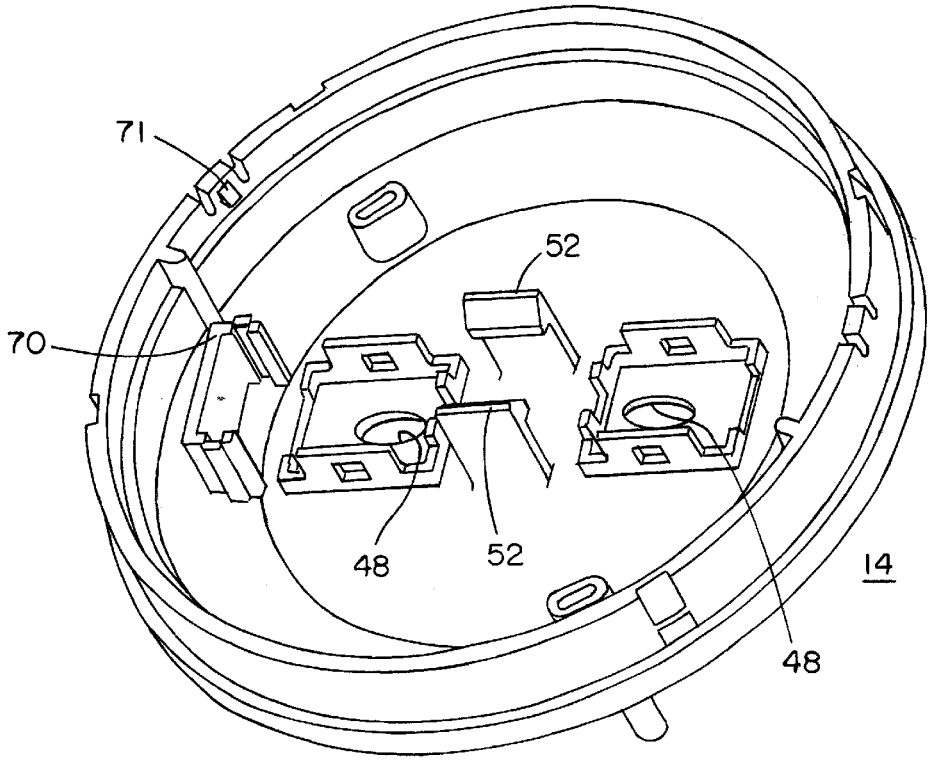
FIG. 8 is an isometric view of a second side of the chamber base illustrated in FIGS. 1–3.

A printed circuit board 54 is provided below the optical bench 50. In one embodiment, electronics of the smoke detector 10 are positioned on the side of the board 54 away from the smoke chamber. The top side of the board 54 is a ground plane that forms one side of a Faraday cage while an RF can 56 positioned underneath the board as shown in FIG. 1 forms the other side of the Faraday cage to isolate the electronic components from external radio frequency emissions. The board 54 can snap-fit onto the bottom of the chamber base 14. As illustrated in FIG. 8, the chamber base includes tabs 71 which can be used to attach the board 54 to the chamber base 14.

Figure 9:
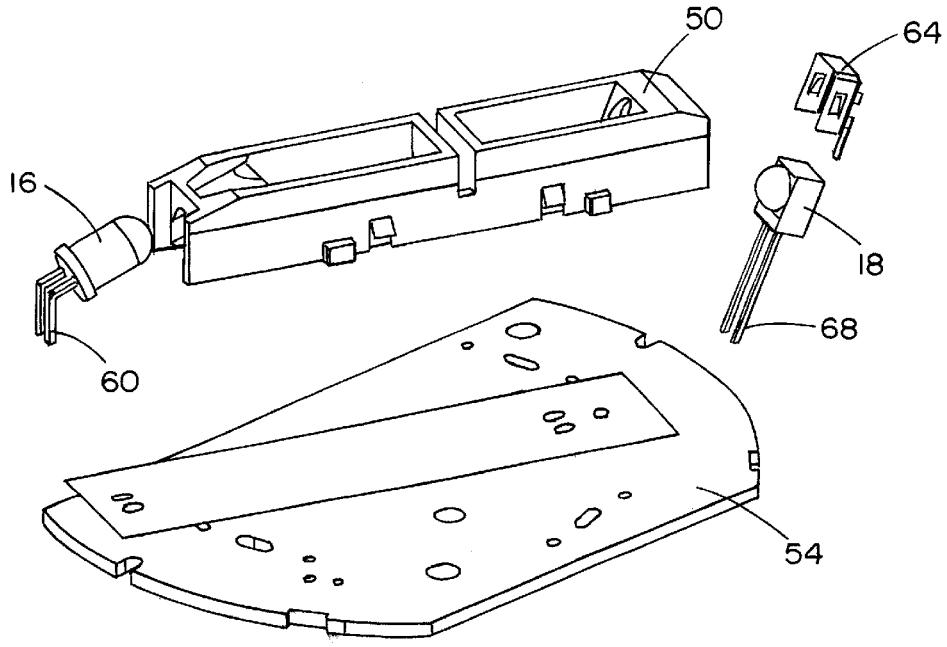
FIG. 9 is an isometric exploded view of the optical bench, emitting and sensing devices, and printed circuit board illustrated in FIGS. 1–3.
Figure 10:
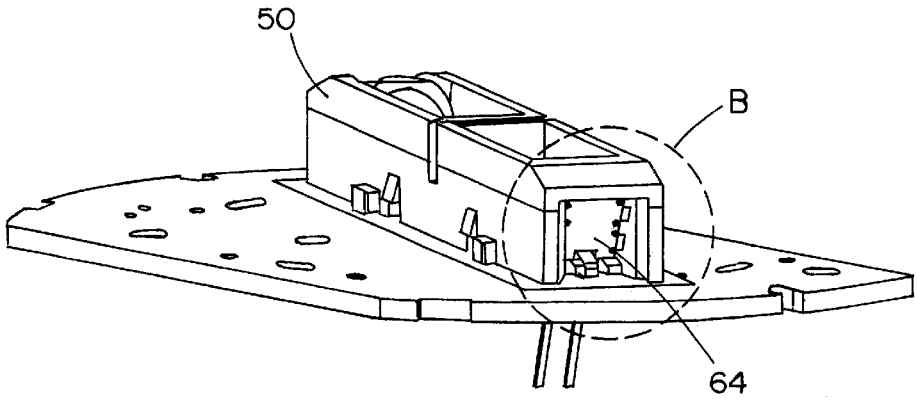
FIG. 10 is an isometric view of the optical bench as assembled to the printed circuit board.
Figure 11:
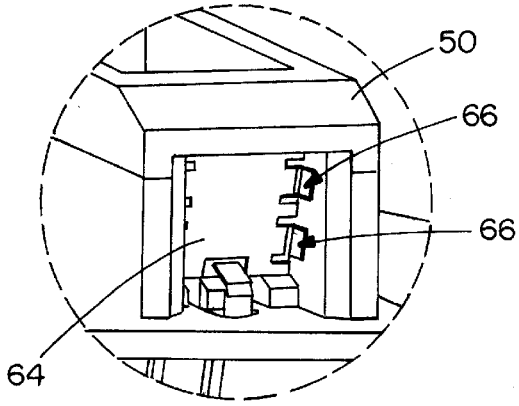
FIG. 11 is an enlarged view of area "B" of FIG. 10.
Figure 12:
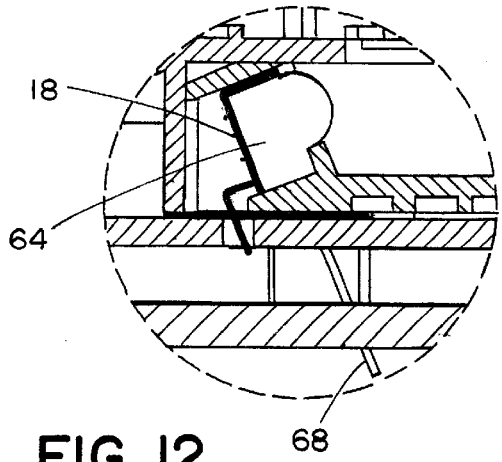
FIG. 12 is an enlarged view of area "C" of FIG. 2.
Figure 13:
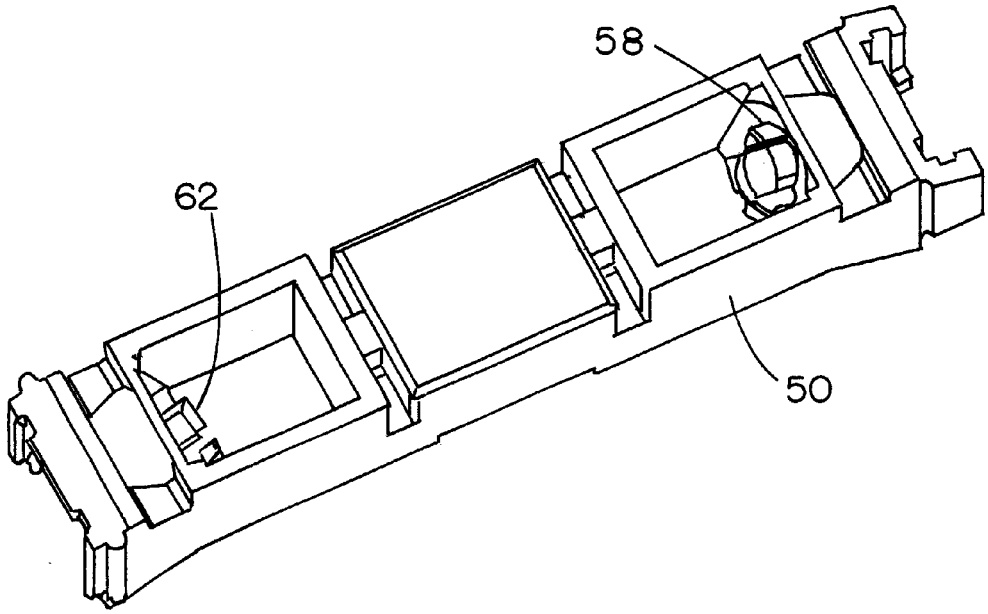
FIG. 13 is an isometric view of a first side of the optical bench.
Figure 14:
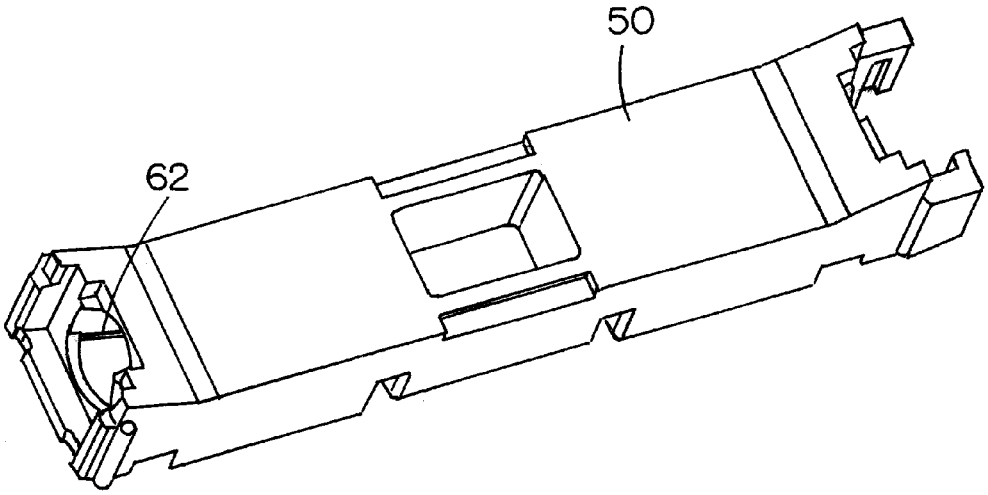
FIG. 14 is an isometric view of a second side of the optical bench.
Figure 15:
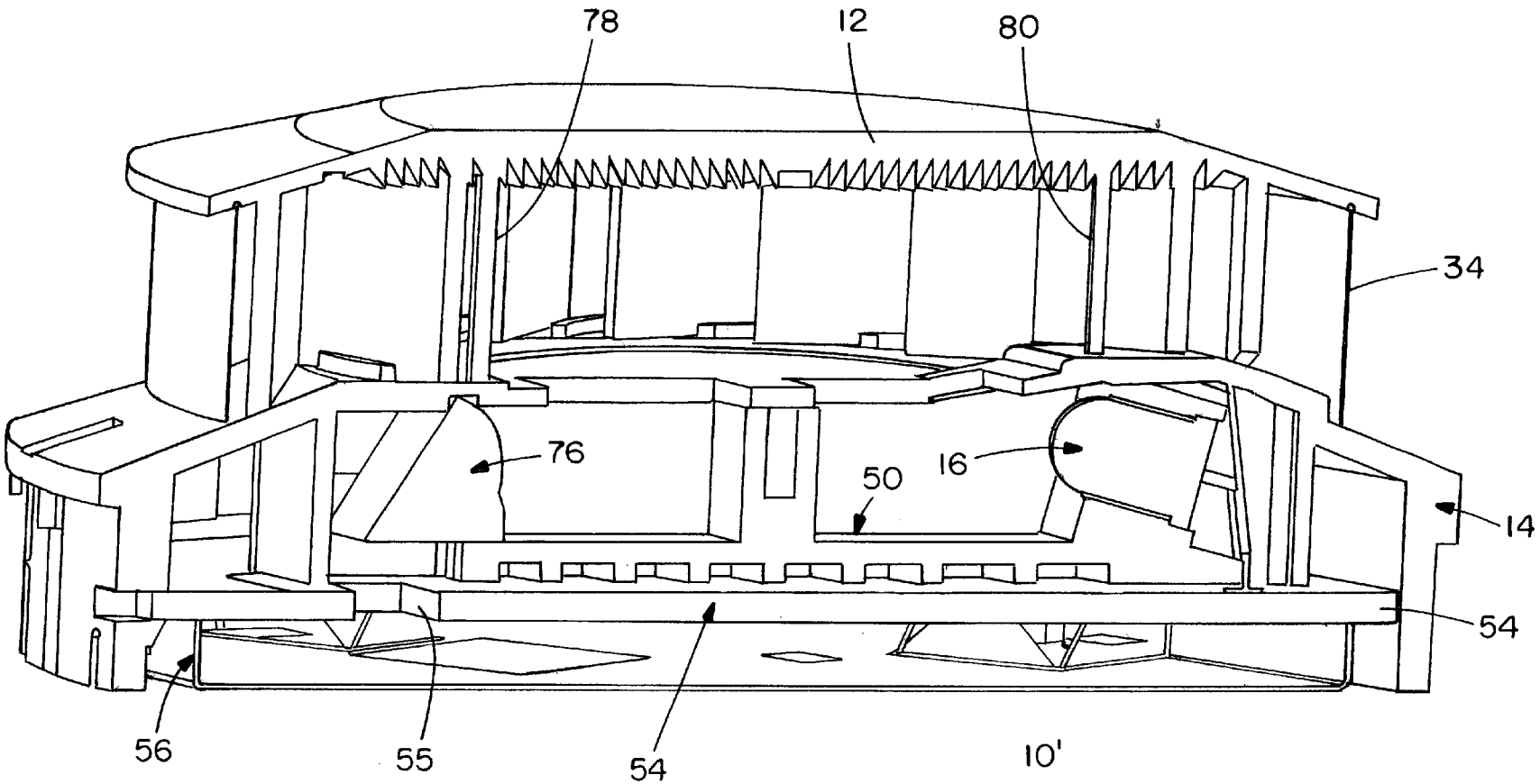
FIG. 15 is a cross-sectional isometric view of an alternative smoke detector.

As illustrated in FIGS. 9 and 13, the optical bench includes crush ribs 58 which hold the emitting device 16 in place. Electrical contacts 60 of the emitting device 16 pass through the board 54 and are soldered thereunder. As shown in FIGS. 10, 11, and 13, the sensing device 18 is held by crush ribs 62 of the optical bench 50. A can 64 is positioned on the back side of the sensing device 18 to isolate the sensing device from external radio frequency emissions and prevent coupling of radiation from the emitting device 16 to the sensing device from the backside thereof. The can 64, in one embodiment, includes locking tabs 66 which snap-fit into the optical bench 50. Electrical contacts 68 of the sensing device 18 pass through the board 54 and are soldered thereunder.

The stack up configuration as illustrated in FIG. 3 is assembled together and placed inside of a cage retainer 72 (see FIGS. 1 and 2). A cage assembly 74 snaps onto the cage retainer 72 to complete the final stack up of the smoke detector 10. In one embodiment, the chamber cover 12, chamber base 14, and optical bench 50 are formed from a conductive, injection-molded ABS plastic.

In one embodiment, the projections 26, 28 are asymmetrically positioned on the chamber base 14 to facilitate proper positioning of the chamber cover 12 on the chamber base. More specifically, if the chamber cover 12 is snap-fit onto the chamber base 14 in the wrong orientation, the unit will not fit into the cage assembly 74.

In an alternative embodiment as illustrated in FIGS. 15–19, the smoke detector 10' includes a lens 76, combined with a reflecting element such as a prism, to redirect radiation toward the sensing device 18. In this embodiment, the sensing device 18 is positioned on the underside of the board 54. An aperture 55 in the board 54 allows communication between the lens 76 and the sensing device 18 through the board.

A first reflecting surface 78 and a second reflecting surface 80 are provided within the smoke chamber for maintaining a "clean air value" within a predetermined range. More specifically, the sensing device 18 senses a given value during non-smoke conditions, which can be referred to as a clean air value. It is desirable to control this clean air value or background level to preserve the dynamic range of the smoke detection function and the dynamic range of the supervisory functions which monitor the electronics.

Preferably, the reflecting surfaces 78 and 80 extend from the chamber cover 12. Reflecting surface 78 is directly impinged by at least some radiation as illustrated by line 82 in FIG. 16. Some of the radiation reflects off of surface 78 toward surface 80, as illustrated by line 84. Some of this radiation reflects off of surface 80 along line 86 toward lens 76 and thus to the sensing device 18. In this manner, the clean air value can be maintained at a predetermined range during non-alarm conditions.

Figure 16:
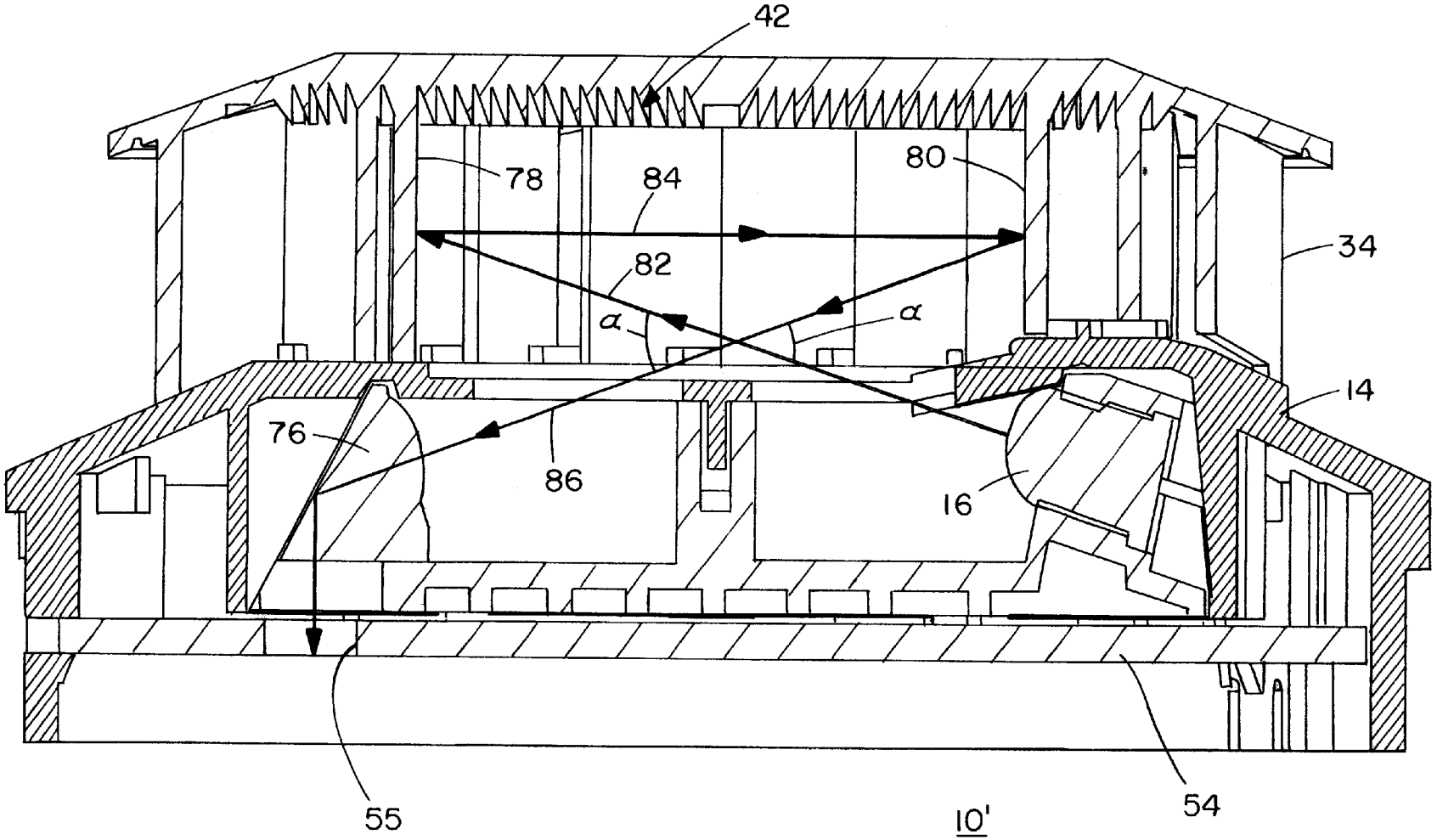
FIG. 16 is a cross-sectional view of the smoke detector of FIG. 15.
Figure 17:
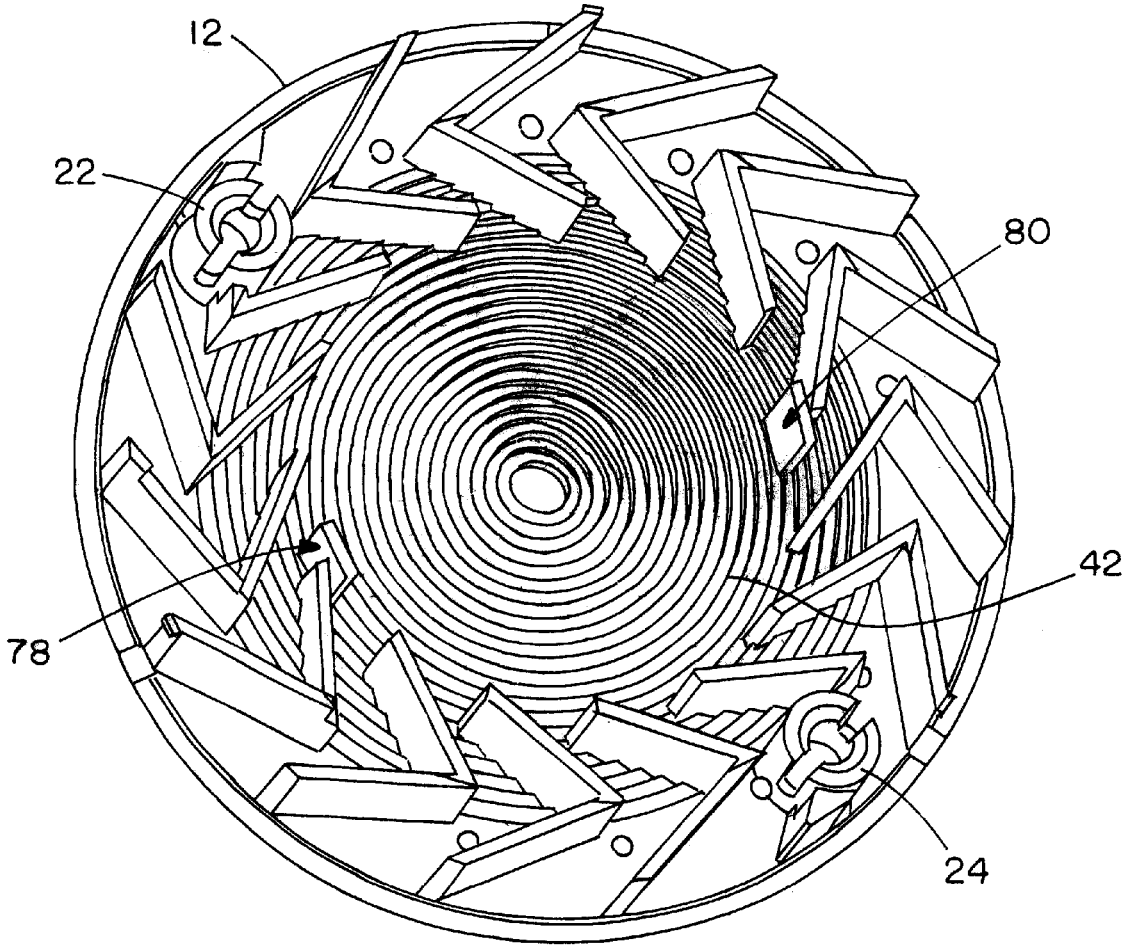
FIG. 17 is an isometric view of the chamber cover of FIG. 15.
Figure 18:
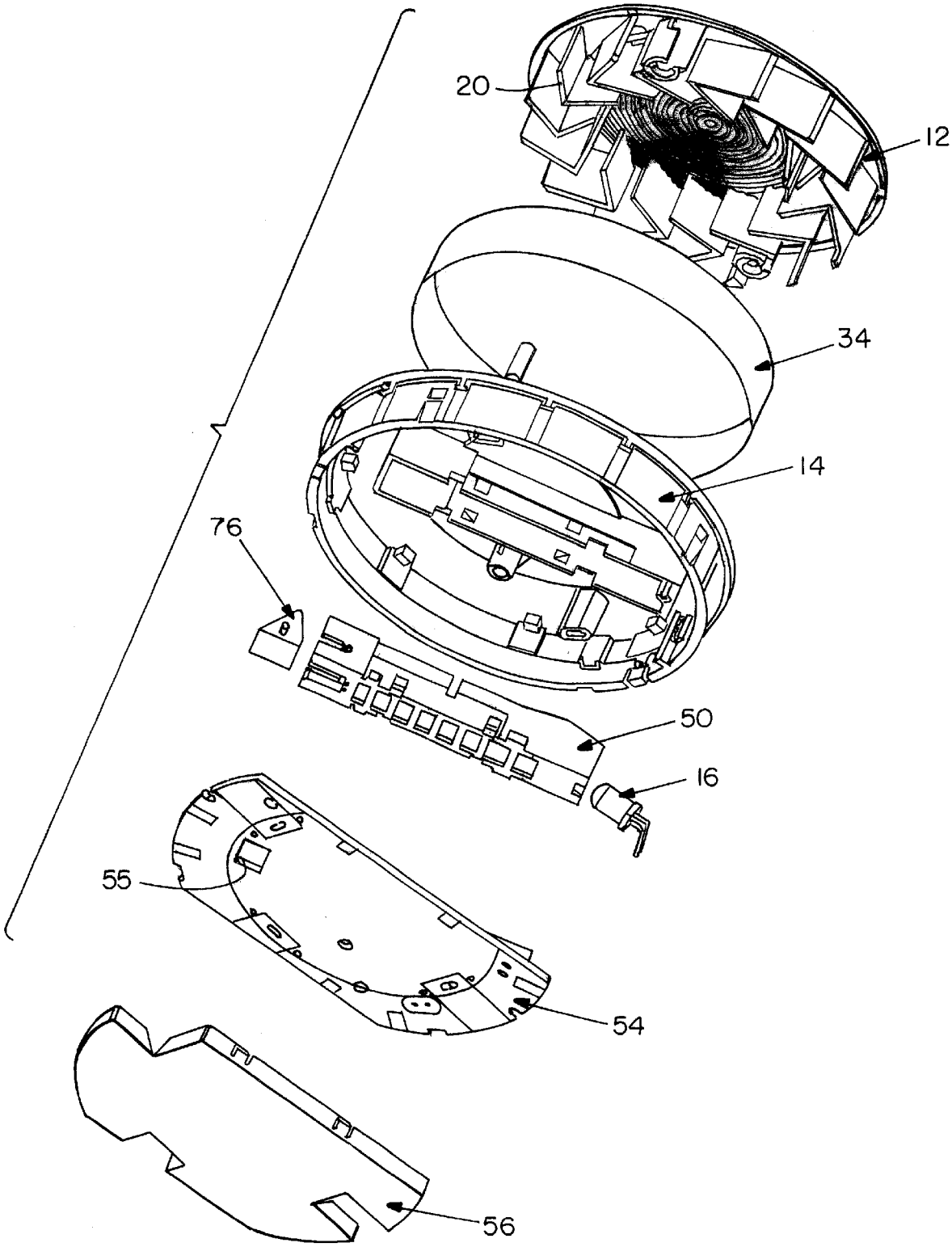
FIG. 18 is an isometric exploded view of the smoke chamber of FIG. 15.

The optical axes of the emitting device 16 and the sensing device 18 intersect, as shown in FIG. 16, at an angle $\alpha$ in the range of between about 30 and 40 degrees, preferably about 37.5 degrees.

Figure 19:
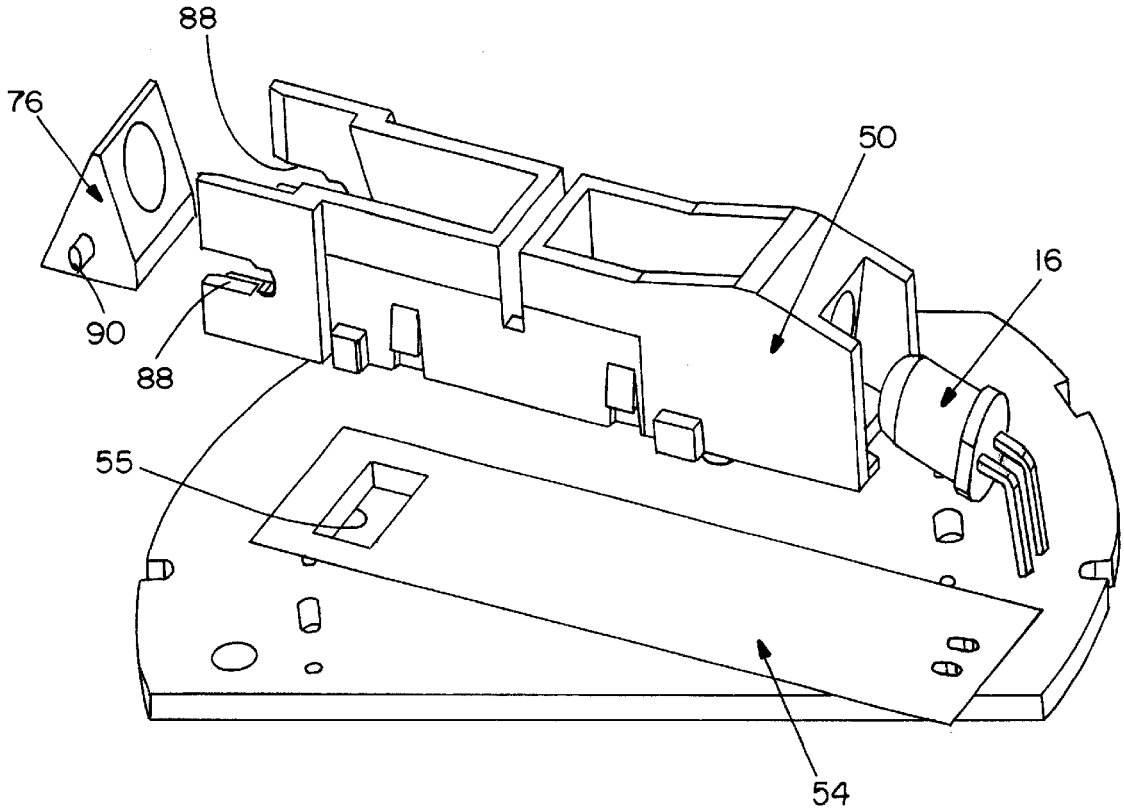
FIG. 19 is an enlarged view of the optical bench, emitting device, and lens as shown in FIGS. 15–16, and 18.

FIG. 19 illustrates the lens 76 prior to being held by the optical bench 50. In this embodiment, the optical bench includes grooves 88 which accept arm members 90 of the lens 76 to hold the lens in position. Preferably, the arm members 90 snap-fit into the grooves 88.

While this invention has been particularly shown and described with references to preferred embodiments thereof, it will be understood by those skilled in the art that various changes in form and details may be made therein without departing from the scope of the invention encompassed by the appended claims.

What is claimed is:

1. A smoke detector, comprising:

a printed circuit board having a first side and a second side;

electronic components positioned on the first side of the board;

a can for isolating the electronic components from external radio frequency emissions, the can being disposed on the first side of the board;

a smoke detecting chamber formed by a chamber cover and a chamber base, the smoke detecting chamber being positioned on the second side of the board, the chamber base including an annular ramp;

an optical bench disposed between the second side of the board and the smoke detecting chamber;

an emitting device held by the optical bench that emits radiation into the smoke chamber; and a sensing device held by the optical bench that senses radiation from the emitting device when smoke fills the smoke detecting chamber.

2. The detector of claim 1, wherein the chamber cover includes a plurality of first baffles that prevent external light from entering the smoke detecting chamber, the baffles conforming to the ramp.

3. The detector of claim 1, wherein the chamber cover includes a plurality of first baffles that prevent external light from entering the smoke detecting chamber and wherein the chamber base includes a plurality of second baffles that intermesh vertically with the first baffles when the smoke detecting chamber is formed to prevent entry of ambient light into the smoke chamber when the base and cover are slightly misaligned or do not substantially conform to one another.

4. The detector of claim 1, wherein at least one projection projects from the chamber base, said projection comprising a snap-fit that engages with a respective retaining member of the chamber cover.

5. The detector of claim 4, wherein the projection includes a light emitting device.

6. The detector of claim 4, wherein the projection includes a temperature measuring device.

7. The detector of claim 1, wherein the chamber cover includes a plurality of circumferential grooves facing the smoke detecting chamber for controlling propagation of stray external light and radiation from the emitting device.

8. The detector of claim 7, wherein the plurality of circumferential grooves are V-shaped grooves with one face of each groove angled approximately 30 degrees relative to a chamber axis.

9. The detector of claim 1, wherein the emitting device and the sensing device are held by crush ribs of the optical bench.

10. The detector of claim 1, further comprising a second can covering a back side of the sensing device.

11. The detector of claim 1, wherein the optical bench is removably attached to the chamber base.

12. A smoke detecting chamber for use in a light-scattering type smoke detector, comprising:

a chamber cover forming one side of the smoke detecting chamber, the chamber cover including a plurality of first baffles that prevent external light from entering the smoke chamber; and a chamber base forming another side of the smoke detecting chamber, the chamber base including a plurality of second baffles that vertically intermesh with the first baffles when the smoke detecting chamber is formed when the base and cover are slightly misaligned or do not substantially conform to one another.

13. The chamber of claim 12, wherein the chamber base includes an annular ramp.

14. The chamber of claim 12, wherein the chamber cover removably attaches to the chamber base.

15. The chamber of claim 14, wherein the chamber base includes a first projection and a second projection formed thereon that engage with respective retaining members of the chamber cover.

16. The chamber of claim 15, wherein the first projection includes a light emitting device.

17. The chamber of claim 15, wherein the second projection includes a temperature measuring device.

18. The chamber of claim 12, wherein the chamber cover includes a plurality of circumferential grooves facing the smoke detecting chamber for controlling propagation of stray external light.

19. The chamber of claim 18, wherein the plurality of circumferential grooves are V-shaped grooves with one face of each groove angled approximately 30 degrees relative to a chamber axis.

20. A smoke detector, comprising:

a printed circuit board having a first side and a second side;

electronic components positioned on the first side of the board;

a can for isolating the electronic components from external radio frequency emissions, the can being disposed on the first side of the board;

a smoke detecting chamber formed by a chamber cover and a chamber base, the smoke detecting chamber being positioned on the second side of the board, the chamber cover including a plurality of first baffles that prevent external light from entering the smoke chamber, the chamber base including a plurality of second baffles that intermesh vertically with the first baffles when the smoke detecting chamber is formed to prevent entry of ambient light into the smoke chamber when the base and cover are slightly misaligned or do not substantially conform to one another;

an optical bench disposed between the second side of the board and the smoke detecting chamber;

an emitting device held by the optical bench that emits radiation into the smoke chamber; and a sensing device held by the optical bench that senses radiation from the emitting device when smoke fills the smoke detecting chamber.

21. The detector of claim 20, wherein the chamber base includes a first projection and a second projection, each projection extending from the chamber base and engaging respective retaining members of the chamber cover to removably secure the chamber cover on the chamber base, the first projection and the second projection being asymmetrically positioned on the chamber base.

22. A smoke detecting chamber for use in a light-scattering type smoke detector, comprising:

a chamber cover forming one side of the smoke detecting chamber, the chamber cover including first means for preventing external light from entering the smoke chamber; and a chamber base forming another side of the smoke detecting chamber, the chamber base including second means that vertically intermesh with the first means when the smoke detecting chamber is formed for preventing external light from entering the smoke chamber to prevent external light from entering the smoke chamber when the base and cover are slightly misaligned or do not substantially conform to one another.

23. A method of preventing light from entering a smoke detecting chamber for use in a light-scattering type smoke detector, comprising:

forming one side of the smoke detecting chamber with a chamber cover, the chamber cover including a plurality of first baffles that prevent external light from entering the smoke chamber; and forming another side of the smoke detecting chamber with a chamber base, the chamber base including a plurality of second baffles that vertically intermesh with the first baffles when the smoke detecting chamber is formed to prevent external light from entering the smoke chamber when the base and cover are slightly misaligned or do not substantially conform to one another.

* * * * *